US011677182B2

(12) United States Patent
Chen

(10) Patent No.: US 11,677,182 B2
(45) Date of Patent: Jun. 13, 2023

(54) CABLE CONNECTOR

(71) Applicant: XIAMEN GHGM INDUSTRIAL TRADE CO., LTD, Xiamen (CN)

(72) Inventor: Bingshui Chen, Xiamen (CN)

(73) Assignee: XIAMEN GHGM INDUSTRIAL TRADE CO., LTD, Xiamen (CN)

( * ) Notice: Subject to any disclaimer, the term of this patent is extended or adjusted under 35 U.S.C. 154(b) by 0 days.

(21) Appl. No.: 17/570,338

(22) Filed: Jan. 6, 2022

(65) Prior Publication Data

US 2023/0085117 A1 Mar. 16, 2023

(30) Foreign Application Priority Data

Sep. 10, 2021 (CN) ..... 202111063464.3

(51) Int. Cl.

| | |
|---|---|
| ***H01R 13/58*** | (2006.01) |
| ***H01R 13/516*** | (2006.01) |
| ***H01R 13/20*** | (2006.01) |
| ***H01R 13/622*** | (2006.01) |
| ***H01R 12/61*** | (2011.01) |
| ***H01R 4/2406*** | (2018.01) |

(52) U.S. Cl.

CPC ..... *H01R 13/582* (2013.01); *H01R 12/616* (2013.01); *H01R 13/20* (2013.01); *H01R 13/516* (2013.01); *H01R 13/622* (2013.01); *H01R 4/2406* (2018.01)

(58) Field of Classification Search

CPC ..... H01R 12/616; H01R 4/24; H01R 12/67; H01R 13/582; H01R 13/622; H01R 4/2406; H01R 13/20

See application file for complete search history.

(56) References Cited

U.S. PATENT DOCUMENTS

| | | | | |
|---|---|---|---|---|
| 2,758,280 A * | 8/1956 | More | ..... | H01R 4/2408 333/136 |
| 4,878,855 A * | 11/1989 | Heng | ..... | H01R 4/2408 439/425 |
| 5,601,448 A * | 2/1997 | Poon | ..... | F21V 21/0824 439/417 |
| 8,616,905 B2 * | 12/2013 | McGregor | ..... | H01R 12/616 439/207 |
| 8,790,128 B2 * | 7/2014 | Andresen | ..... | H01R 13/622 439/404 |

* cited by examiner

*Primary Examiner* — Briggitte R. Hammond

(57) ABSTRACT

A cable connector relates to a field of cable connecting technology. The cable connector includes a main body assembly including an insulating main body and conductive main bodies, a first clamping assembly, and a second clamping assembly. The conductive main bodies are disposed on the insulating main body. Two ends of each of the conductive main bodies extend outwards from bottom portions of the first accommodating groove and the second accommodating groove. The two ends of each of the conductive main bodies are sharp structures. The first clamping assembly includes a first clamping piece movably disposed up and down in the first accommodating groove and a first operating piece disposed on the insulating main body. The second clamping assembly includes a second clamping piece movably disposed up and down in the second accommodating groove and a second operating piece disposed on the insulating main body.

10 Claims, 6 Drawing Sheets

CABLE CONNECTOR

TECHNICAL FIELD

The present disclosure relates to a field of cable connecting technology, and in particular to a cable connector.

BACKGROUND

Electrical connection of two cables often requires removal of an insulating layer wrapping cables, then connect conductors of the cables, and then wrap the conductors of cables with an insulating material to complete the electrical connection of the two cables. This process is relatively cumbersome. Therefore, cable connectors that have appeared on the market electrically connect the two cables conveniently.

Generally speaking, the two cables are a power supply cable connected to a power supply and a power cable connected to an electrical device. In the prior art, the cable connector only electrically connects one end of the power cable to a middle portion of the power supply cable, so that the electrical device obtains electric energy from the power supply cable through the power cable. However, the cable connector is impossible to connect a middle portion of the power cable with the middle portion of the power supply cable to make two ends of the power cable to be connected to different electric devices.

Moreover, in the prior art, when one end of the power cable is electrically connected to the cable connector, the insulating layer of the power cable needs to be removed before it is connected to the cable connector, operation steps of which are cumbersome to use.

In view of this, the researcher specially submits the present disclosure after studying the prior art. It should be mentioned that information disclosed in the background is only intended to make a general background of the present disclosure clear and easy to understand, and should not be regarded as an acknowledgement or in any form implying that the information constitutes the well-known prior art known by those of ordinary skill in the art.

SUMMARY

The present disclosure provides a cable connector to solve above mentioned problems.

To solve the above technical problems, the present disclosure provides a cable connector. The cable connector comprises a main body assembly, a first clamping assembly, and a second clamping assembly.

The main body assembly comprises an insulating main body and conductive main bodies. The insulating main body comprises a first accommodating groove and a second accommodating groove. The first accommodating groove is configured to accommodate a first cable and a second accommodating groove is configured to accommodate a second cable. The conductive main bodies are disposed on the insulating main body. A first end of each of the conductive main bodies extends outwards from a bottom portion of the first accommodating groove and a second end of each of the conductive main bodies extends outwards from a bottom portion of the second accommodating groove. The first end of each of the conductive main bodies and the second end of each of the conductive main bodies are sharp structures.

The first clamping assembly comprises a first clamping piece movably disposed up and down in the first accommodating groove and a first operating piece disposed on the insulating main body. The first operating piece is configured to drive the first clamping piece to move close to the bottom portion of the first accommodating groove.

The second clamping assembly comprises a second clamping piece movably disposed up and down in the second accommodating groove and a second operating piece disposed on the insulating main body. The second operating piece is configured to drive the second clamping piece to move close to the bottom portion of the second accommodating groove.

The first cable is extended into the first clamping channel defined between the first clamping piece and the first accommodating groove. The second cable is extended into the second clamping channel defined between the second clamping piece and the second accommodating groove. The first operating piece abuts against the first clamping piece to make the first cable abutting against the first end of each of the conductive main bodies. The second operating piece abuts against the second clamping piece to make the second cable abutting against the second ends of each of the conductive main bodies; so the first end of each of the conductive main bodies and the second end of each of the conductive main bodies separately puncture an insulation layer of the first cable and an insulation layer of the second cable to conduct the first cable and the second cable.

In one optional embodiment, the first accommodating groove is disposed opposite to the second accommodating groove. The insulating main body comprises a partition portion. The partition portion forms the bottom portion of the first accommodating groove and the bottom portion of the second accommodating groove. First through holes are on the partition portion. The conductive main bodies are accommodated in the first through holes.

In one optional embodiment, the main body assembly further comprises a fixing seat. The fixing seat is configured to fix the conductive main bodies to the insulating main body.

Each of the conductive main bodies comprises a positioning protrusion. Accommodating cavities are formed between the fixing seat and the partition portion. Each of the accommodating cavities is configured to receive a corresponding positioning protrusion to fix a corresponding conductive main body.

In one optional embodiment, the fixing seat is fixed to the insulating main body through buckle structures.

The buckle structures comprise sliding rails and first buckle protrusions. The sliding rails are defined on sidewalls of the first accommodating groove and the second accommodating groove and are communicated with the first accommodating groove and the second accommodating groove. The first buckle protrusions are disposed on the sliding rails. One side of each of the first buckle protrusions along a direction of the sliding rails defines a first guiding surface that is inclined.

The buckle structures further comprise second buckle protrusions disposed on a periphery of the fixing seat. The second buckle protrusions are matched with the sliding rails. Each of the second buckle protrusions comprises a second guiding surface matched with a corresponding first guiding surface.

In one optional embodiment, the partition portion comprises a fixed groove configured to accommodate the fixing seat. Each of the first through holes comprises a counterbore configured to accommodate a corresponding positioning protrusion. Each positioning protrusion is chamfered.

In one optional embodiment, the first clamping piece and/or the second clamping piece is provided with a mounting groove configured to accommodate the cable. Limit protrusions are disposes on two sides of an opening of each mounting groove. Each mounting groove is perforated along its length. The limit protrusions of each mounting groove extend in a width direction of each mounting groove from the two sides of the opening of each mounting groove to prevent the cable from falling out of each mounting groove.

In one optional embodiment, the first operating piece and/or the second operating piece is matched with the insulating main body through threaded structures to drive the first clamping piece and/or the second clamping piece to move close to or away from the bottom portion of the first accommodating groove and/or the second accommodating groove.

The first operating piece is rotatably disposed on the first clamping piece. The second operating piece is rotatably disposed on the second clamping piece.

In one optional embodiment, external threads are disposed on an outer surface of the insulating main body. Internal threads are disposed on the first operating piece and/or the second operating piece. The first operating piece and/or the second operating piece is sleeved on the insulating main body to drive the first clamping piece and/or the second clamping piece to move close to or away from the bottom portion of the first accommodating groove and/or the second accommodating groove through the internal threads.

The first accommodating groove is perforated along a length direction of the first accommodating groove and/or the second accommodating groove is perforated along a length direction of the second accommodating groove. First connecting portions and second connecting portions are separately disposed on two sides of the insulating main body disposed in a width direction of the first accommodating groove and/or a width direction of the second accommodating groove. The first operating piece and/or the second operating piece is matched with the first connecting portions and the second connecting portions through threaded structures.

In one optional embodiment, an outer surface of the insulating main body is arc-shaped and comprises non-slip structures, or, the outer surface of the insulating main body comprises clamping surfaces. The clamping structures are parallelly arranged and are configured to be clamped by an external object.

In one optional embodiment, a structure of the first clamping assembly is same as a structure of the second clamping assembly.

The two ends of the conductive main bodies are respectively arranged in the first accommodating groove and the second accommodating groove. The first operating piece and the second operating piece are separately configured to drive the first clamping piece and the second clamping piece to move close to the bottom portion of the first accommodating groove and the bottom portion of the second accommodating groove. Thus, the conductive main bodies are electrically connected to the two cables in the first accommodating groove and the second accommodating groove. The cable connector of the present disclosure is not only simple in structure, but also simple in operation. A user only needs to put the two cables in the clamping channels and drive operating pieces to clamp the clamping pieces.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor.

IN THE DRAWINGS

Figure 1:
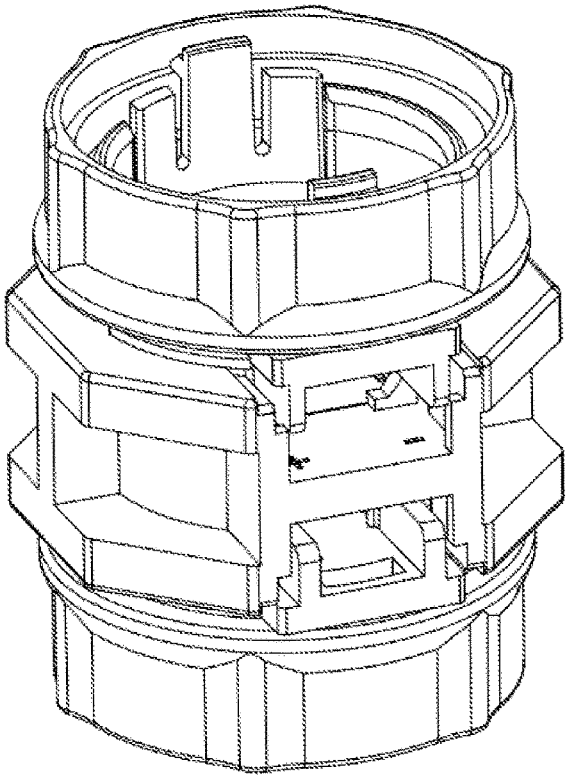
FIG. 1 is a perspective schematic diagram of a cable connector, adopting an insulating main body with a first shape.

1—first clamping assembly; 2—first operating piece; 3—first clamping piece; 4—main body assembly; 5—fixing seat; 6—conductive main body; 7—insulating main body; 8—second clamping assembly; 9—second clamping member; 10—second operating piece; 11—clamping surface; 12—non-slip structure; 13—first accommodating groove; 14—first connecting portion; 15—second accommodating groove; 16—second connecting portion; 17—second buckle protrusion; 18—first buckle protrusion; 19—sliding rail; 20—first through hole; 21—partition portion; 22—fixed groove; 23—positioning protrusion; 24—limit protrusion; 25—mounting groove; 26—first sidewall; 27—second sidewall.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure. Therefore, following detailed description of the embodiments of the present disclosure provided in the accompanying drawings is not intended to limit the scope of the present disclosure, but merely represents selected embodiments of the present disclosure. Based on the embodiments of the present disclosure, all other embodiments obtained by a person of ordinary skill in the art without creative work shall fall within the protection scope of the present disclosure.

It should be understood that in the description of the present disclosure terms such as "central", "lateral", "lengthways", "length", "width", "thickness", "upper", "lower", "left", "right", "vertical", "horizontal", "top", "bottom", "inner", "outer", "clockwise", "counterclockwise", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

In addition, terms such as "first" and "second" are only used for the purpose of description, rather than being understood to indicate or imply relative importance or hint the number of indicated technical features. Thus, the feature limited by "first" and "second" can explicitly or impliedly include one or more features. In the description of the present disclosure, the meaning of "a plurality of" is two or more unless otherwise specified.

It should be noted in the description of the present disclosure that, unless otherwise regulated and defined, terms such as "installation," "bonded," and "connection" shall be understood in broad sense, and for example, may refer to fixed connection or detachable connection or integral connection; may refer to mechanical connection or electrical connection; and may refer to direct connection or indirect connection through an intermediate medium or inner communication of two elements. For those of ordinary skill in the art, the meanings of the above terms in the present disclosure may be understood according to concrete conditions.

In the present disclosure, unless expressly stipulated and defined otherwise, the first feature is arranged "above" or "below" the second feature may mean that the first feature directly contact the second feature, or the first feature does not directly contact the second feature but connected with the second feature through other features between them. Furthermore, the first feature is arranged "on", "above" or "over" the second feature means that the first feature may arrange directly above and obliquely above the second feature, or it may merely indicate that a level of the first feature is greater than a level of the second feature. The first feature is arranged "below", "under", and "beneath" the second feature means that the first feature is arranged directly below and obliquely below the second feature, or it simply means that the level of the first feature is less than the level of second feature.

The present disclosure will be further described in detail below in conjunction with the drawings and specific embodiments:

As shown in FIGS. 1-10, the present disclosure provides a cable connector. The cable connector comprises a main body assembly 4, a first clamping assembly 1, and a second clamping assembly 8.

The main body assembly 4 comprises an insulating main body 7 and conductive main bodies 6. The insulating main body 7 comprises a first accommodating groove 13 and a second accommodating groove 15. The first accommodating groove 13 and a second accommodating groove 15 are configured to accommodate a respective cable. The conductive main bodies 6 are disposed on the insulating main body 7. A first end of each of the conductive main bodies 6 extends outwards from a bottom portion of the first accommodating groove 13 and a second end of each of the conductive main bodies 6 extends outwards from a bottom portion of the second accommodating groove 15. The first end of each of the conductive main bodies 6 and the second end of each of the conductive main bodies 6 are sharp structures.

The first clamping assembly 1 comprises a first clamping piece 3 movably disposed up and down in the first accommodating groove 13 and a first operating piece 2 disposed on the insulating main body 7. The first operating piece 2 is configured to drive the first clamping piece 3 to move close to the bottom portion of the first accommodating groove 13.

The second clamping assembly 8 comprises a second clamping piece 9 movably disposed up and down in the second accommodating groove 15 and a second operating piece 10 disposed on the insulating main body 7. The second operating piece 10 is configured to drive the second clamping piece 9 to move close to the bottom portion of the second accommodating groove 15.

Two cables are respectively extended into a first clamping channel and a second clamping channel. The first clamping channel is defined between the first clamping piece 3 and the first accommodating groove 13. The second clamping channel is defined between the second clamping piece 9 and the second accommodating groove 15. The first operating piece 2 and the second operating piece 10 separately abut against the first clamping piece 3 and the second clamping piece 9 to make the two cables separately abutting against the first end of each of the conductive main bodies 6 and the second ends of each of the conductive main bodies 6, so the first end of each of the conductive main bodies and the second end of each of the conductive main bodies puncture an insulation layer of each of the two cables to conduct the two cables.

Specifically, the insulating main body 7 comprises the first accommodating groove 13 and the second accommodating groove 15. A first end of the first accommodating groove 13 in a length direction is communicated with a second end of the first accommodating groove 13 in the length direction, and a first end of the second accommodating groove 15 in the length direction is communicated with a second end of the second accommodating groove 15 in the length direction, so the two cables are received in the first accommodating groove 13 and the second accommodating groove 15. The first clamping piece 3 is able to move up and down in the first accommodating groove 13 to away from or close to the bottom portion of the first accommodating groove 13. The first operating piece 2 is movably disposed on the insulating main body 7 to drive the first clamping piece 3 to move up and down in the first accommodating groove 13. In the embodiment, the first operating piece 2 is connected to the insulating main body 7 through threaded structures, and the first clamping piece 3 is rotatably arranged on the first operating piece 2. The first operating piece 2 is rotated to drive the first clamping piece 3 to move up and down. The working mechanism of the second clamping piece 9 and the second operating piece 10 is same as that of the first clamping piece 3 and the first operating piece 2, and is not repeated herein.

The conductive main bodies 6 are disposed on the insulating main body 7. The first end of each of the conductive main bodies 6 extends outwards from the bottom portion of the first accommodating groove 13 and the second end of each of the conductive main bodies 6 extends outwards from the bottom portion of the second accommodating groove 15. Further, the first end of each of the conductive main bodies 6 and the second end of each of the conductive main bodies 6 are sharp structures, so the conductive main bodies 6 are electrically communicated with the first accommodating groove 13 and the second accommodating groove 15. The first operating piece 2 is configured to drive the first clamping piece 3 to move close to the bottom portion of the first accommodating groove 13. The second operating piece 10 is configured to drive the second clamping piece 9 to move close to the bottom portion of the second accommodating groove 15. Therefore, the two cables separately abut against the first end of each of the conductive main bodies 6 and the second ends of each of the conductive main bodies 6, so the first end of each of the conductive main bodies and the second end of each of the conductive main bodies puncture an insulation layer of each of the two cables to contact the cores of the two cables.

The cable connector of the present disclosure has a simple structure. The first clamping piece 3 is directly disposed on the first operating piece 2 and the second clamping piece 9 is directly disposed on the second operating piece 10. Therefore, the whole cable connector are divided into three parts, that is, the main body assembly 4, the first clamping assembly 1, and the second clamping assembly 8. which greatly reduces number of components of the cable connector and makes the cable connector convenient to carry when used.

In addition, during use, the two cables are fixed in an orderly manner, and the use of the cable connector is orderly and is not rushed. There is no need to fix the two cables at the same time, which prevents a problem of the two cables from falling out of the first accommodating groove and the second accommodating groove due to cable twisting, and prevents the two cables from being left unbalanced. Specially, pressure applied to the two cables is adjusted separately, so that when specifications of the two cables on two sides of the cable connector are different, a good connection effect is still achieved.

Figure 7:
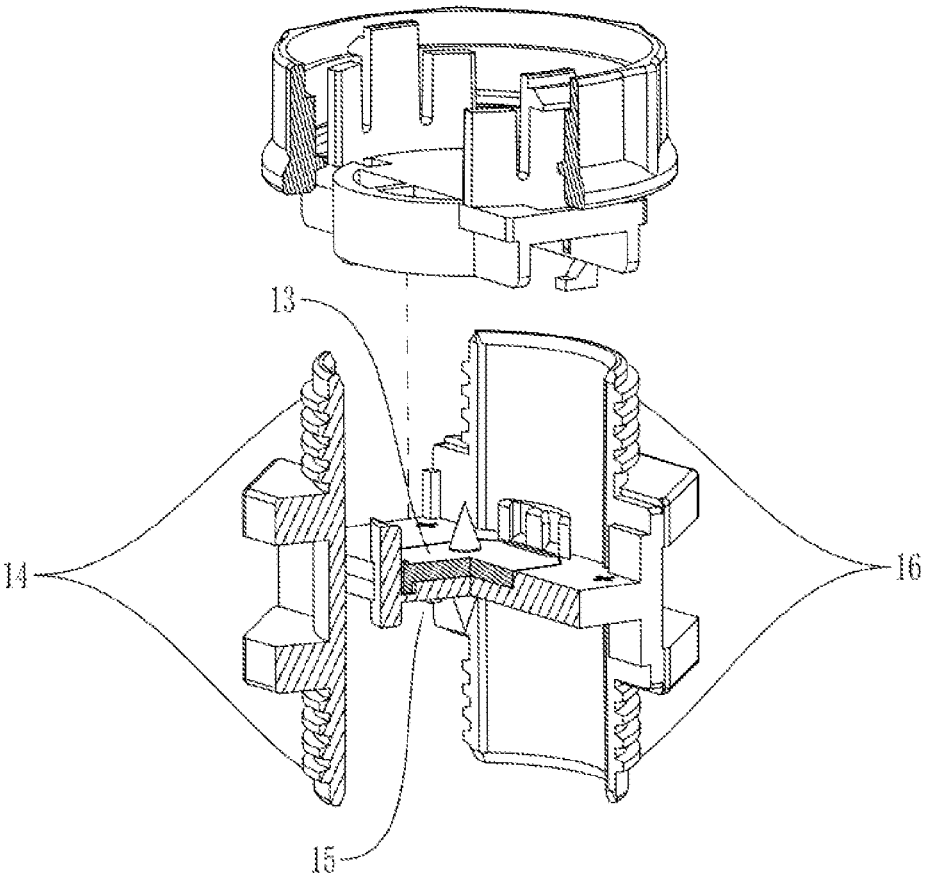
FIG. 7 is an exploded cross-sectional schematic diagram of the main body assembly and the first clamping piece.
Figure 8:
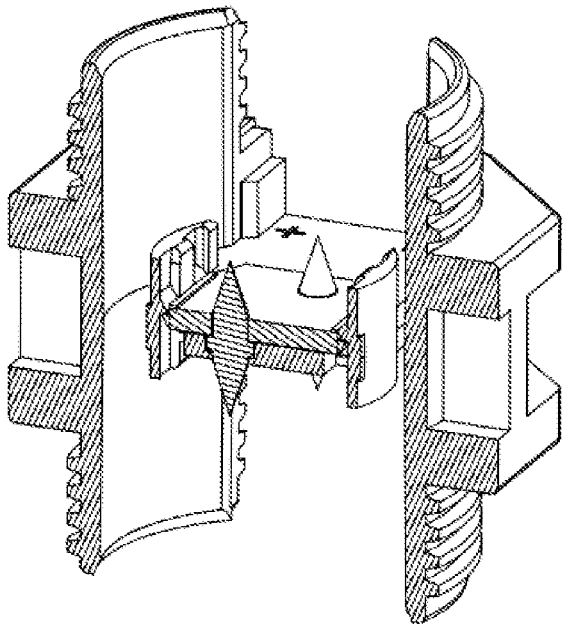
FIG. 8 is a perspective cross-sectional schematic diagram of the main body assembly.
Figure 9:
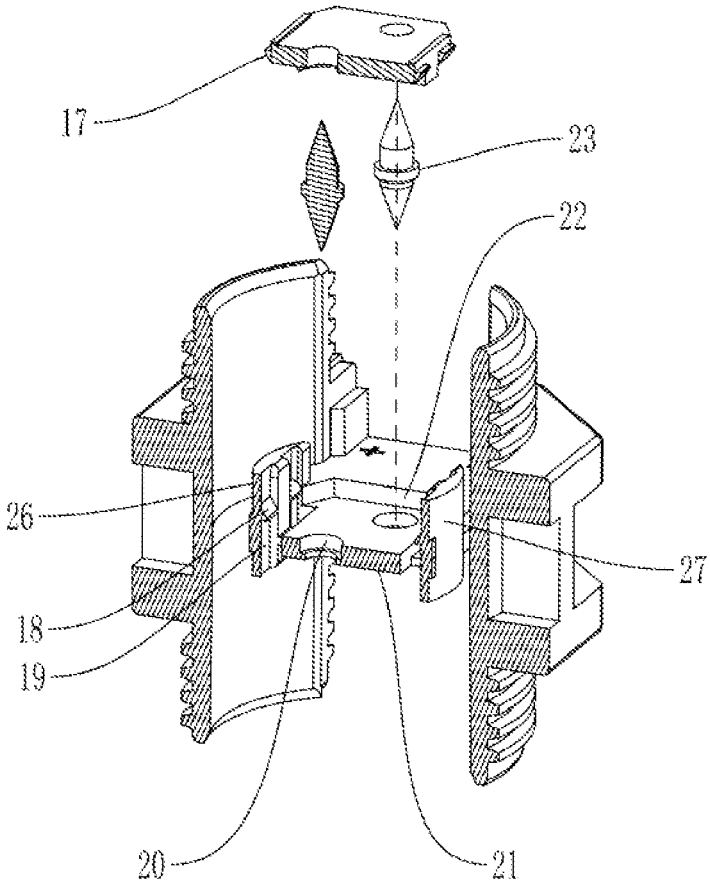
FIG. 9 is an exploded cross-sectional schematic diagram of the main body assembly.

As shown in FIGS. 7-9, on basis of the foregoing embodiment, in one optional embodiment of the present disclosure, the first accommodating groove 13 is disposed opposite to the second accommodating groove 15. The insulating main body 7 comprises a partition portion 21. The partition portion 21 forms the bottom portion of the first accommodating groove 13 and the bottom portion of the second accommodating groove 15. First through holes 20 are on the partition portion 21. The conductive main bodies 60 are accommodated in the first through holes 20.

The first accommodating groove 13 is disposed opposite to the second accommodating groove 15 means that an opening of the first accommodating groove 13 and an opening of the second accommodating groove 15 face two opposite directions. Specifically, two opposite sides of the insulating main body 7 are respectively provided with the first accommodating groove 13 and the second accommodating groove 15. A middle position of the insulating main body 7 is of a plate structure. Two sides of the plate structure are separately defined as the bottoms portion of the first accommodating groove 13 and the bottom portion of the second accommodating groove 15. The plate structure is the partition portion 21. The conductive main bodies 6 are disposed in the plate structure. Each of the conductive main bodies 6 is a columnar geometric body with tapered ends, which has a simple structure, is easy to produce, and has low cost.

Optionally, the main body assembly 4 comprises two conductive main bodies 6, and the two conductive main bodies 6 are disposed from left to right along a width direction of the first accommodating groove 13 and a width direction of the second accommodating groove 15. The two conductive main bodies 6 are disposed one behind the other along a length direction of the first accommodating groove 13 and a length direction of the second accommodating groove 15, so that a distance between the two conductive main bodies 6 is farthest to meet requirements of creepage distance and electrical clearance.

As shown in FIGS. 8-9, on basis of the foregoing embodiments, in one optional embodiment of the present disclosure, the main body assembly 4 further comprises a fixing seat 5. The fixing seat 5 is configured to fix the conductive main bodies 6 to the insulating main body 7. Each of the conductive main bodies 6 comprises a positioning protrusion 23. Accommodating cavities are formed between the fixing seat 5 and the partition portion 21. Each of the accommodating cavities are configured to receive a corresponding positioning protrusion 23 to fix a corresponding conductive main body 6. Each of the first through holes 20 comprises a counterbore configured to accommodate a corresponding positioning protrusion 23. Each positioning protrusion 23 is chamfered.

In the embodiment, each positioning protrusion 23 is disposed on a middle portion of each of the conductive main bodies 6. When the conductive main bodies 6 pass through the first through holes 20, each positioning protrusion 23 is embedded in a corresponding counterbore of a corresponding first through hole 20. The fixing seat 5 is sleeved on the conductive main bodies 6 and is attached to a surface of the partition portion 21. The partition portion 21 and the fixing seat 5 respectively wraps each positioning protrusion 23 from two sides of each positioning protrusion 23. Thus, the conductive main bodies 6 are fixed to the insulating main body 7. Furthermore, two ends of each of the conductive main bodies 6 are exposed to the first accommodating groove 13 and the second accommodating groove 15 respectively.

In other embodiments, the conductive main bodies 6 are fixed to the insulating main body 7 in an interference fit manner, and the fixing seat 5 is not required. Alternatively, the conductive main bodies 6 are directly fixed in the first through holes 20 through structures such as threads. The present disclosure does not specifically limit how the conductive main bodies 6 are fixed to the insulating main body 7.

As shown in FIGS. 7-9, on basis of the foregoing embodiments, in one optional embodiment of the present disclosure, the fixing seat 5 is fixed to the insulating main body 7 through buckle structures.

The buckle structures comprise sliding rails 19 and first buckle protrusions 18. The sliding rails 19 are defined on sidewalls of the first accommodating groove 13 and sidewalls of the second accommodating groove 15 and are communicated with the first accommodating groove 13 and the second accommodating groove 15. The first buckle protrusions 18 are disposed on the sliding rails 19. One side of each of the first buckle protrusions 18 along a direction of the sliding rails 19 defines a first guiding surface that is inclined.

The buckle structures further comprise second buckle protrusions 17 disposed on a periphery of the fixing seat 5. The second buckle protrusions 17 are matched with the sliding rails 19. Each of the second buckle protrusions 19 comprises a second guiding surface matched with a corresponding first guiding surface.

In the embodiment, a widths of the first accommodating groove 13 is same as a width of the second accommodating groove 15. That is, the sidewalls of the first accommodating groove 13 and the sidewalls of the second accommodating groove 15 are on a same plane. The sliding rails 19 are arranged along the sidewalls of the first accommodating groove 13 and the sidewalls of the second accommodating groove 15 and the first buckle protrusions 18 are disposed on the sliding rails 19. The insulating main body 7 is an injection-molded piece. During production, it is only necessary to provide two molding protrusions opposite to each other on a mold, and there is a molding gap between molded protrusions. It is understandable that the sliding rails 19 are formed at positions of the molded protrusions, and the first buckle protrusions 18 are formed at positions of the molding gap. A structure of the mold for producing the insulating main body 7 is simpler, which greatly reduces cost of the mold, that is, the production cost is reduced.

Structures of the sliding rails 19 and the first buckle protrusions 18 not only save materials during production but also makes subsequent assembly simple. It only needs to embed the conductive main bodies 6 in the first through holes 20. Then, the fixing seat 5 is pressed into the insulating main body 7 to complete fixing, which further saves the costs.

The one side of each of the first buckle protrusions 18 away from the bottom portion of the accommodating grooves defines the first guiding surface that is inclined. The one side of each of the second buckle protrusions 17 close to the bottom portion of the accommodating grooves defines the second guiding surface that is inclined. When the fixing seat 5 is pressed, each first guiding surface abuts against the corresponding second guiding surface, so that the first buckle protrusions 18 buckle the second buckle protrusions 17 smoothly.

Specifically, in other embodiments, protrusions and grooves may be directly provided on the fixing seat 5 and the sidewalls of the accommodating grooves respectively, so as to form buckle structures. Thus, the sliding rails 19 are not required. Alternatively, the fixing seat 5 may be fixed to the insulating main body 7 by means of glue, ultrasonic welding or the like, which is not limited thereto. However, if the grooves is provided directly, it is necessary to set a sliding block on the mold, which is costly.

Optionally, the partition portion 21 comprises a fixed groove 22 configured to accommodate the fixing seat 5. The fixing seat 5 is embedded in the fixed groove 22, so that a bottom surface of the first accommodating groove and a bottom surface of the second accommodating groove is flat, so as to facilitate the placement of the two cables.

Figure 3:
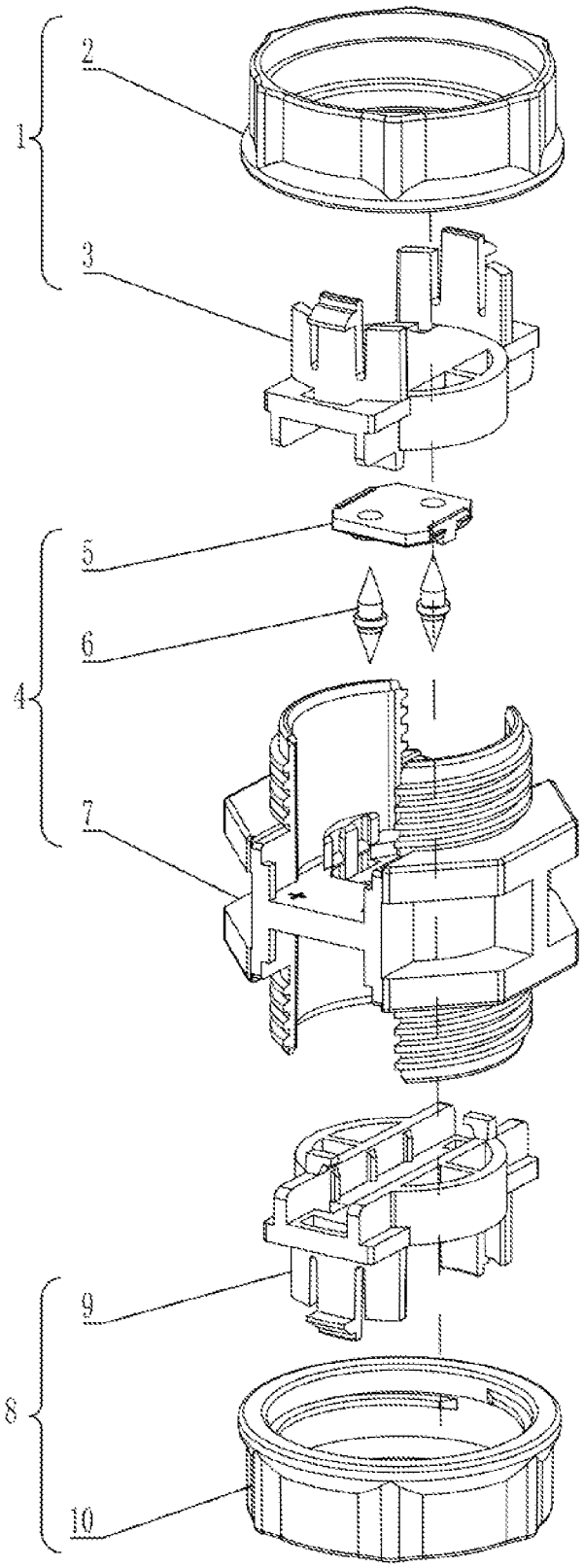
FIG. 3 is an exploded schematic diagram of the cable connector.
Figure 6:
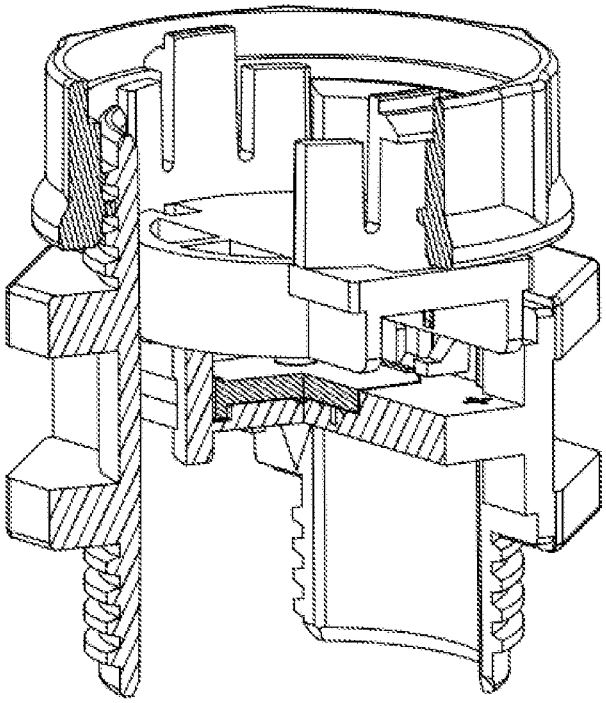
FIG. 6 is a cross-sectional schematic diagram where a main body assembly is assembled with a first clamping piece.

As shown in FIGS. 3, 6, and 7, on basis of the foregoing embodiments, in one optional embodiment of the present disclosure, the first operating piece 2 and/or the second operating piece 10 is matched with the insulating main body 7 through threaded structures to drive the first clamping piece 3 and/or the second clamping piece 9 to move close to or away from the bottom portion of the first accommodating groove 13 and/or the second accommodating groove 15.

In the embodiment, external threads are disposed on an outer surface of the insulating main body 7. Internal threads are disposed on the first operating piece 2 and/or the second operating piece 10. The first operating piece 2 and/or the second operating piece 10 is sleeved on the insulating main body 7 to drive the first clamping piece and/or the second clamping piece to move close to or away from the bottom portion of the first accommodating groove and/or the second accommodating groove through the thread structures.

Optionally, the first accommodating groove is perforated along a length direction of the first accommodating groove 13 and/or the second accommodating groove 13 is perforated along a length direction of the second accommodating groove. First connecting portions 14 and second connecting portions 16 are separately disposed on two sides of the insulating main body 7 disposed in a width direction of the first accommodating groove 13 and/or a width direction of the second accommodating groove 15. The first operating piece 2 and/or the second operating piece 10 is matched with the first connecting portions 14 and the second connecting portions 16 through threaded structures.

As shown in FIGS. 3 and 6-9, the first connecting portion 14 and the second connecting portion 16 are separately disposed on two sides of the insulating main body 7 disposed in a width direction of the first accommodating groove 13 and/or a width direction of the second accommodating groove 15. An opening is formed between each first connecting portion 14 and a corresponding second connecting portion 16 to receive the first accommodating groove 13 and the second accommodating groove 15 therein. The first operating piece and the second operating piece are separately sleeved on the first connecting portion 14 and the second connecting portion 16. The openings on two sides of the insulating main body 7 are symmetrically arranged.

The first clamping piece and the second clamping piece have an abutting surface extending outward along the length direction of the first accommodating groove and the length direction of the second accommodating groove. A diameter of each abutting surface is greater than an outer diameter of the first connecting portion 14 and an outer diameter of the second connecting portion 16 so as to be able to abut against the first operating piece and the second operating piece. The first clamping piece and the second clamping piece comprise a snap extending along a depth direction of the accommodating grooves. Each snap is snapped on a corresponding operating piece. The snaps and the abutting surfaces cooperate with each other, so that the operating pieces cannot move up and down on the clamping pieces, but only rotatable.

That is, the first operating piece 2 is rotatably arranged on the first clamping piece 3. The second operating piece 10 is rotatably disposed on the second clamping piece 9. As a result, the entire cable connector is divided into three separate components: the main body assembly 4, the first clamping assembly 1, and the second clamping assembly 8 which makes the cable connector easy to assemble and store.

Because the first connecting portions 14 and the second connecting portions 16 comprise external threads. Therefore, outer surfaces of the first connecting portions 14 and outer surfaces of the second connecting portions 16 are arc-shaped. Optionally, the first connecting portions 14 and the second connecting portions 16 are of thin plate-like structures, so that they form a slot facing one side of the accommodating grooves. The clamping pieces comprises arc-shaped protrusions at corresponding positions of the slot, thereby limiting a freedom degree of the clamping pieces to move in a horizontal direction in the accommodating grooves.

In other embodiments, limit structures may be disposed between the first connecting portions 14 and/or the second connecting portions 16 and the clamping pieces to limit the freedom degree of the clamping pieces to move in the horizontal direction. Structures of the limiting structures are not limited thereto.

Optionally, the partition portion 21 is a plate structure, and comprises a first sidewall 26 extending along a thickness direction of the partition portion 21 and a second sidewall 27 extending along the thickness direction of the partition portion 21. The first accommodating groove 13 and the second accommodating groove 15 are formed between the first sidewall 26 and the second sidewall 27. Both of the first sidewall 26 and the second sidewall 27 comprises two sliding rails 19 and two first buckle protrusions 18.

In the embodiment, the first connecting portions 14 are disposed on one side of the first sidewall 26 away from the accommodating grooves. The second connecting portions 16 are disposed on one side of the second sidewall 27 away from the accommodating grooves. Further, a first gap is formed between the first connecting portions 14 and the first sidewall 26. A second gap is formed between the second connecting portions 16 and the second sidewall 27. Two sides in a width direction of the clamping pieces are respectively provided with first arc-shaped protrusions that are inserted into the first gap and a second arc-shaped protrusions that are inserted into the second gap. A second through hole for the first sidewall 26 to pass through is defined in a middle portion of the first arc-shaped protrusion. A third through hole for the second sidewall 27 to pass through is defined in a middle portion of the second arc-shaped protrusion.

It is understood that, in the embodiment, the first connecting portions 14 and the second connecting portions 16 are sleeved on the clamping pieces. The first arc-shaped protrusions of the clamping pieces are sleeved in the first sidewall 26, and the second arc-shaped protrusions are sleeved in the second sidewall 27. Through multiple sleeve connections, the clamping pieces are stably disposed in the accommodating grooves and are not easy to shake and have very good practical significance.

Furthermore, the first gap is formed between the first connecting portions 14 and the first sidewall 26. The second gap is formed between the second connecting portions 16 and the second sidewall 27. There is no need to fill the first gap and the second gap with raw materials, which greatly saves production materials. Moreover, the first sidewall 26 and the second sidewall 27 have certain elasticity. Therefore, the fixing seat 5 is moveable along the sliding rails 19 to make the second buckle protrusions 17 to move from one side of the first buckle protrusions 18 to the other side of the first buckle protrusions 18, thereby forming the buckle structure and fixing to the insulating main body 7.

In other embodiments, the first operating piece 2 and the second operating piece 10 may be fasteners such as bolts and are configured to fix the first clamping piece 3 and the second clamping piece 9 to the insulating main body 7. Specific structures of the first operating piece 2, the second operating piece 10, the first clamping piece 3, and the second clamping piece 9 are not limited thereto.

Figure 10:
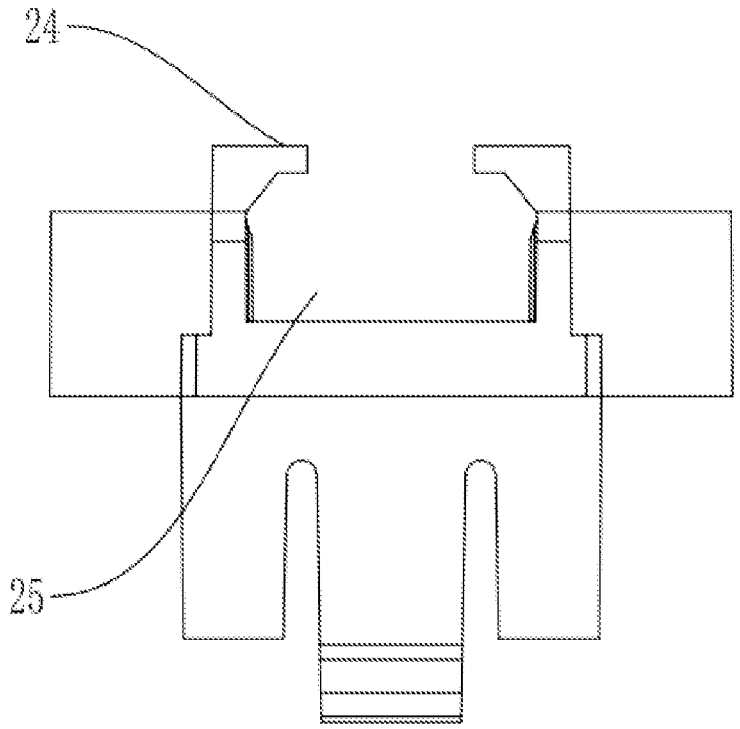
FIG. 10 is a left side schematic diagram of a first clamping piece.

As shown in FIG. 10, on basis of the foregoing embodiments, in one optional embodiment of the present disclosure, the first clamping piece 2 and/or the second clamping piece 10 is provided with a mounting groove 25 configured to accommodate the two cables. Limit protrusions 24 are disposes on two sides of an opening of each mounting groove 25. Each mounting groove 25 is perforated along its length. The limit protrusions 24 of each mounting groove extend in a width direction of each mounting groove 25 from the two sides of the opening of each mounting groove 25 to prevent the two cables from falling out of each mounting groove 25.

Optionally, a structure of the first clamping piece 3 is same as a structure of the second clamping piece 9.

Two sides of the first clamping piece and two sides of the second clamping piece extend upward to form the mounting grooves 25 configured to accommodate the two cables in a middle portion. In addition, the limiting protrusions 24 extending toward a middle portion of each mounting groove are respectively disposed on two sides of each mounting groove 25. When the two cables are inserted into the installation grooves 25, each of the two cables moves along a depth direction of a corresponding mounting groove 25, and each of the two cables is limited by corresponding limit protrusions 24, which prevents the two cables from falling out of the mounting grooves 25. In other words, when the cable connector is used, the two cables are fixed to the clamping pieces first, and then the clamping pieces are fixed to the insulating main body 7, thereby realizing fixation and connection of the two cables.

It is understood that the first clamping assembly 1 and the second clamping assembly 8 of the present disclosure respectively cooperate with the main body assembly 4. Therefore, the main body assembly 4 comprises non-slip structures 12 for hand or external tools to apply torsion force.

Figure 4:
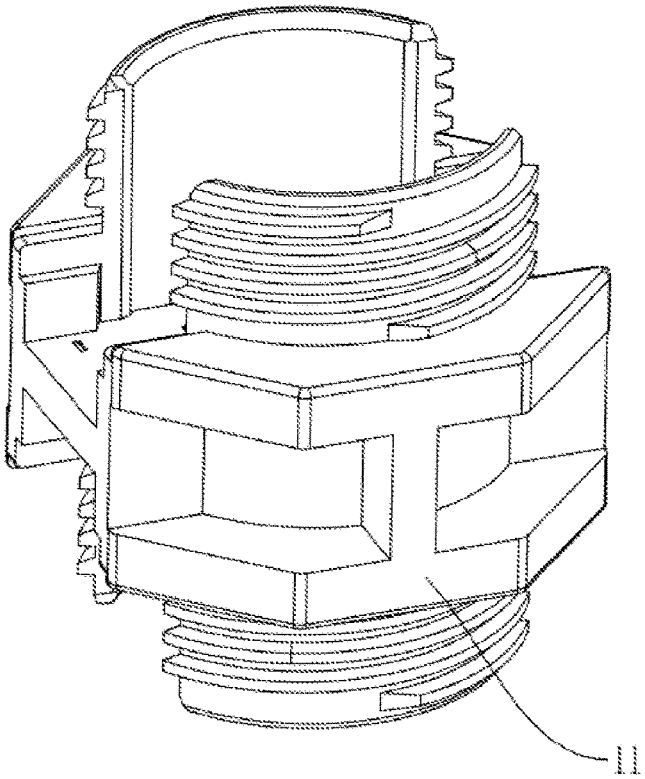
FIG. 4 is a perspective schematic diagram of the insulting main body with the first shape.

As shown in FIG. 4, on basis of the foregoing embodiments, in one optional embodiment of the present disclosure, an outer surface of the insulating main body 7 comprises clamping surfaces 11. The clamping structures are parallelly arranged and are configured to be clamped by an external object. Optionally, a middle section of the insulating main body 7 is arranged as a parallel octagonal structure, so that it can be clamped from different angles.

Figure 5:
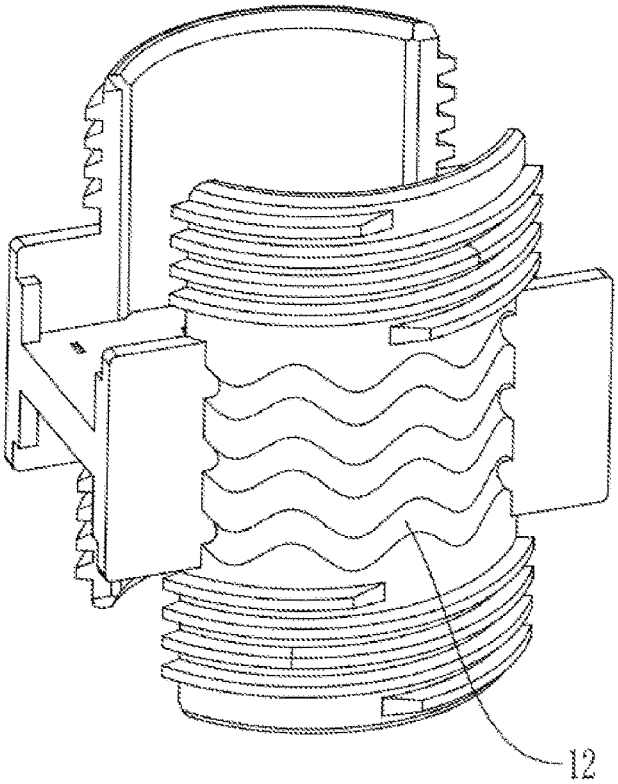
FIG. 5 is a perspective schematic diagram of the insulting main body with the second shape.

As shown in FIG. 5, on basis of the foregoing embodiments, in one optional embodiment of the present disclosure, the outer surface of the insulating main body 7 is arc-shaped and comprises the non-slip structures 12.

In other embodiments, the non-slip structures 12 are not required, but the first clamping assembly 1 and the second assembly are rotated in opposite directions to provide rotational force for each other. A specific shape of the insulating main body 7 of the present disclosure is not limited thereto.

Figure 2:
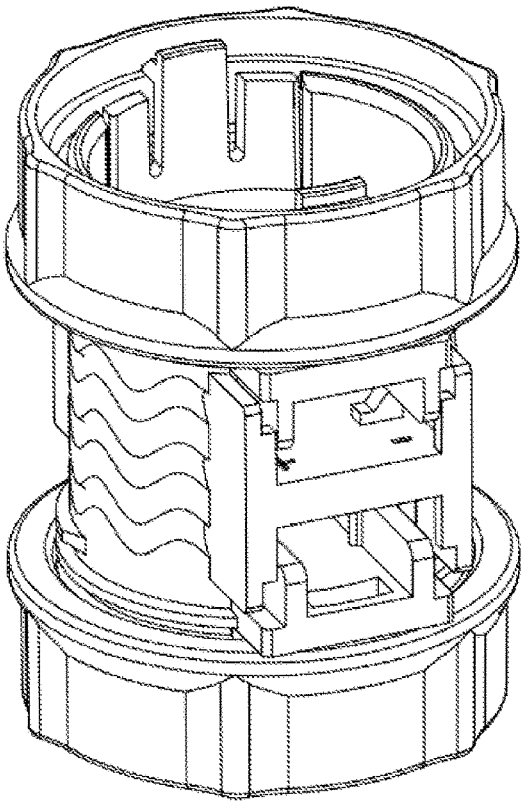
FIG. 2 is a perspective schematic diagram of the cable connector, adopting the insulating main body with a second shape.

As shown in FIG. 2, on basis of the foregoing embodiments, in one optional embodiment of the present disclosure, a structure of the first clamping assembly 1 is same as a structure of the second clamping assembly 8. The structure of the first clamping piece 3 is same as the structure of the second clamping piece 9. A structure of the first operating piece 2 is same as a structure of the second operating piece 10. During production, it only needs to produce five components: the insulating main body 7, the conductive main bodies 6, the fixing seat 5, the clamping pieces, and the operating pieces, which greatly saves the number of molds required to produce the cable connector, greatly saves the cost, and has very good practical significance.

It should be noted that, in the embodiment, a structure of the first clamping assembly is same as a structures of the second clamping assembly. The first buckle protrusions, the sliding rails and the first through holes on the insulating main body are symmetrically arranged with respect to a center of the insulating main body. In addition, except for the above-mentioned centrally symmetrically arranged structures, other structures of the insulating main body are also symmetrically arranged. Therefore, the above-mentioned accommodating grooves, clamping pieces, operating pieces, etc., which do not specifically point out that two symmetrically arranged structures are provided and not distinguished with "first" or "second", represent that the first and second features have a same structure.

In other embodiments, the first clamping assembly 1 and the second clamping assembly 8 may have a same structure but may have different sizes to accommodate cables of different specifications, the size of which is not specifically limited in the present disclosure.

The above are only optional embodiments of the present disclosure and cannot be interpreted as limiting of the protection scope of the present disclosure. For those skilled in the art, the present disclosure can have various modifications and changes. Any modification, equivalent replacement, improvement, etc. made within the spirit and principle of the present disclosure should be included in the protection scope of the present disclosure.

What is claimed is:

1. A cable connector, comprising:

a main body assembly;

a first clamping assembly; and a second clamping assembly;

wherein the main body assembly comprises an insulating main body and conductive main bodies; the insulating main body comprises a first accommodating groove configured to accommodate a first cable and a second accommodating groove; configured to accommodate a second cable; the conductive main bodies are disposed on the insulating main body; a first end of each of the conductive main bodies extends outwards from a bottom portion of the first accommodating groove and a second end of each of the conductive main bodies extends outwards from a bottom portion of the second accommodating groove; the first end of each of the conductive main bodies and the second end of each of the conductive main bodies are sharp structures;

wherein the first clamping assembly comprises a first clamping piece movably disposed up and down in the first accommodating groove and a first operating piece disposed on the insulating main body; the first operating piece is configured to drive the first clamping piece to move close to the bottom portion of the first accommodating groove;

wherein the second clamping assembly comprises a second clamping piece movably disposed up and down in the second accommodating groove and a second operating piece disposed on the insulating main body; the second operating piece is configured to drive the second clamping piece to move close to the bottom portion of the second accommodating groove;

wherein the first cable is extended into a first clamping channel defined between the first clamping piece and the first accommodating groove; the second cable is extended into a second clamping channel defined between the second clamping piece and the second accommodating groove; the first operating piece abuts against the first clamping piece to make the first cable abutting against the first end of each of the conductive main bodies; the second operating piece abuts against the second clamping piece to make the second cable abutting against the second ends of each of the conductive main bodies; so the first end of each of the conductive main bodies and the second end of each of the conductive main bodies separately puncture an insulation layer of the first cable and an insulation layer of the second cable to conduct the first cable and the second cable.

2. The cable connector according to claim 1, wherein the first accommodating groove is disposed opposite to the second accommodating groove; the insulating main body comprises a partition portion; the partition portion forms the bottom portion of the first accommodating groove and the bottom portion of the second accommodating groove; first through holes are on the partition portion; the conductive main bodies are accommodated in the first through holes.

3. The cable connector according to claim 2, wherein the main body assembly further comprises a fixing seat; the fixing seat is configured to fix the conductive main bodies to the insulating main body;

wherein each of the conductive main bodies comprises a positioning protrusion; accommodating cavities are formed between the fixing seat and the partition portion; each of the accommodating cavities is configured to receive a corresponding positioning protrusion to fix a corresponding conductive main body.

4. The cable connector according to claim 3, wherein the fixing seat is fixed to the insulating main body through buckle structures;

wherein the buckle structures comprise sliding rails and first buckle protrusions; the sliding rails are defined on sidewalls of the first accommodating groove and sidewalls of the second accommodating groove and are communicated with the first accommodating groove and the second accommodating groove; the first buckle protrusions are disposed on the sliding rails; one side of each of the first buckle protrusions along a direction of the sliding rails defines a first guiding surface that is inclined;

wherein the buckle structures further comprise second buckle protrusions disposed on a periphery of the fixing seat; the second buckle protrusions are matched with the sliding rails; each of the second buckle protrusions comprises a second guiding surface matched with a corresponding first guiding surface.

5. The cable connector according to claim 3, wherein the partition portion comprises a fixed groove configured to accommodate the fixing seat; each of the first through holes comprises a counterbore configured to accommodate a corresponding positioning protrusion; each positioning protrusion is chamfered.

6. The cable connector according to claim 1, wherein the first clamping piece and/or the second clamping piece is provided with a mounting groove configured to accommodate a corresponding cable; limit protrusions are disposes on two sides of an opening of each mounting groove; each mounting groove is perforated along its length; the limit protrusions of each mounting groove extend in a width direction of each mounting groove from the two sides of the opening of each mounting groove to prevent the corresponding cable from falling out of each mounting groove.

7. The cable connector according to claim 1, wherein the first operating piece and/or the second operating piece is matched with the insulating main body through threaded structures to drive the first clamping piece and/or the second clamping piece to move close to or away from the bottom portion of the first accommodating groove and/or the second accommodating groove;

wherein the first operating piece is rotatably disposed on the first clamping piece; the second operating piece is rotatably disposed on the second clamping piece.

8. The cable connector according to claim 1, wherein external threads are disposed on an outer surface of the insulating main body; internal threads are disposed on the first operating piece and/or the second operating piece; the first operating piece and/or the second operating piece is sleeved on the insulating main body to drive the first clamping piece and/or the second clamping piece to move close to or away from the bottom portion of the first accommodating groove and/or the second accommodating groove;

the first accommodating groove is perforated along a length direction of the first accommodating groove and/or the second accommodating groove is perforated along a length direction of the second accommodating groove; first connecting portions and second connecting portions are separately disposed on two sides of the insulating main body disposed in a width direction of the first accommodating groove and/or a width direction of the second accommodating groove; the first operating piece and/or the second operating piece is matched with the first connecting portions and the second connecting portions through threaded structures.

9. The cable connector according to claim 1, wherein an outer surface of the insulating main body is arc-shaped and comprises non-slip structures, or, the outer surface of the insulating main body comprises clamping surfaces; the clamping structures are parallelly arranged and are configured to be clamped by an external object.

10. The cable connector according to claim 1, wherein a structure of the first clamping assembly is same as a structure of the second clamping assembly.

* * * * *